US006912782B2

(12) United States Patent
Nguyen et al.

(10) Patent No.: US 6,912,782 B2
(45) Date of Patent: Jul. 5, 2005

(54) FORMING AND ASSEMBLY METHOD FOR MULTI-AXIAL PIVOTING COMBUSTOR LINER IN GAS TURBINE ENGINE

(75) Inventors: Ly D. Nguyen, Phoenix, AZ (US); Gregory O. Woodcock, Mesa, AZ (US); Stony Kujala, Tempe, AZ (US)

(73) Assignee: Honeywell International Inc., Morristown, NJ (US)

( * ) Notice: Subject to any disclaimer, the term of this patent is extended or adjusted under 35 U.S.C. 154(b) by 130 days.

(21) Appl. No.: 10/410,794

(22) Filed: Apr. 9, 2003

(65) Prior Publication Data

US 2004/0200069 A1 Oct. 14, 2004

(51) Int. Cl.[7] ..... B23P 15/00

(52) U.S. Cl. ..... 29/888.01; 29/889; 29/889.2; 60/755; 60/757

(58) Field of Search ..... 60/39.02, 39.65, 60/39.66, 39.69, 752–760; 29/888.01, 889.2, 889, 464, 434, 428, 890.01, 525.01

(56) References Cited

U.S. PATENT DOCUMENTS 2,955,415 A * 10/1960 Long ..... 239/127.1
3,420,058 A * 1/1969 Howald et al. ..... 60/757
3,613,360 A 10/1971 Howes
4,614,082 A 9/1986 Sterman et al.
5,172,545 A 12/1992 Forestier
5,701,670 A 12/1997 Fisher et al.
5,911,680 A 6/1999 Takeoka
5,921,075 A 7/1999 Shimoyama et al.
6,141,862 A 11/2000 Matsui et al.
6,205,661 B1 * 3/2001 Ring ..... 29/890.01
6,212,870 B1 4/2001 Thompson et al.
6,434,821 B1 8/2002 Nelson et al.
6,688,100 B1 * 2/2004 Wherley et al. ..... 60/257
2002/0184763 A1 * 12/2002 Emilianowicz ..... 29/890.01

* cited by examiner

*Primary Examiner*—Irene Cuda-Rosenbaum
(74) *Attorney, Agent, or Firm*—Robert Desmond, Esq.

(57) ABSTRACT

A multi-axial pivoting liner within the combustion system of a turbine engine allows the system to work with minimum thermal interference, especially during system operation at transient conditions, by allowing the liner to pivot and slide about its centerline and relative to the turbine scroll. The pivoting liner has the ability to control and minimize air leakage from part to part, for example, from the liner to the turbine scroll, during various operating conditions. Additionally, the liner provides for easy assembly with no flow path steps. Finally, the pivoting liner tolerates thermal and mechanical stresses and minimizes thermal wear.

23 Claims, 6 Drawing Sheets

FORMING AND ASSEMBLY METHOD FOR MULTI-AXIAL PIVOTING COMBUSTOR LINER IN GAS TURBINE ENGINE

GOVERNMENT RIGHTS

This invention was made with support from the U.S. Government. The Government has certain rights in this invention.

BACKGROUND OF THE INVENTION

The present invention generally relates a method for fabricating and assembling a combustor liner in a turbine engine, and, more specifically, to a method for fabricating and assembling a multi-axial pivoting combustor liner in a gas turbine engine.

A gas turbine engine includes a compressor that provides pressurized air to a combustor wherein the air is mixed with fuel and burned for generating hot combustion gases. These gases flow downstream to one or more turbines that extract energy therefrom to power the compressor and provide useful work such as powering an aircraft in flight. Combustors used in aircraft engines typically include a combustor liner to protect surrounding engine structure from the intense heat generated by the combustion process.

A conventional combustor liner has a cylindrical shape with one open end. A thin sheet metal material, capable of withstanding high temperature conditions, is usually used to fabricate the body through a forming process. The liner is often supported on one end or suspended by a few points. The conventional liner assembly and fabrication technique is adequate only for low cycle and low performance engines.

U.S. Pat. No. 3,613,360, referring to FIG. 1, discloses a radial combustion chamber having an outer case (14) enclosing an inner casing (15, 20) to form an annular combustion chamber. An air plenum or passage extends along the outer side of the combustion chamber. Multiple flanges are bolted together to form a combustion chamber. Bolts and threaded assemblies are used to make the joints, there is no pivoting features present in the combustion chamber.

U.S. Pat. No. 4,614,082 discloses a radial combustor liner having a plurality of panels mounted by means of a slideable friction mounting arrangement upon a high strength structural frame. Bolts are relied upon to fasten the aft end and the free support at the forward end. Tongue grooves are mainly used for engaging panels that make up the liner. Thus, the resulting combustor lacks any pivoting features during operation.

U.S. Pat. No. 6,434,821 discloses a method of fabricating an annular radial liner for a combustion chamber. The patent is concerned with improvements in the strength and durability of the liner by using a large forging with several joggles and scallop to ease thermal stress (12). See FIG. 1. Sheet metal members are jointed and welded into an annular section (50, 52 and 54). The aft end of the liner is bolted to the case in both the axial and radial directions (34). Therefore, the large radial liner has limited axial sliding with no multi-axial pivoting capabilities.

As can be seen, there is a need for an improved method for making a multi-axial pivoting combustor liner for gas turbine engines. A combustor liner made by such an improved method must have the ability to control small amounts of air leakage, provide easy assembly, have no flow path steps, and tolerate thermal and mechanical stresses while minimizing thermal wear and fretting for the life of the liner.

SUMMARY OF THE INVENTION

In one aspect of the present invention, a method for making a multi-axial pivoting liner for a turbine engine comprises moveably connecting the multi-axial pivoting liner with a combustion gas output receiving device at a lower joint, and moveably attaching a liner to a housing at an upper joint; wherein the lower joint and the upper joint provide multiple axes of movement for the liner.

In another aspect of the present invention, a method for making a multi-axial pivoting liner for a turbine engine comprises moveably connecting the multi-axial pivoting liner with a turbine scroll at a lower joint; moveably attaching an atomizer to the liner at an upper joint, wherein the lower joint and the upper joint provide multiple axes of movement for the liner; maintaining the upper joint in a connected state by providing a first resilient force to the liner in a first direction from the swirler to the liner with a vibration damper/thermal and mechanical spring; providing a second resilient force to the liner in a second direction, orthogonal to the first direction, thereby minimizing movement of the liner in the second direction; inserting an igniter in a hole in the liner, the hole having a diameter larger than a diameter of the igniter; and moveably sealing the igniter in the hole with a grommet.

In yet another aspect of the present invention, a method for making a multi-axial pivoting liner for a turbine engine of a high-performance aircraft comprises moveably connecting the multi-axial pivoting liner with a turbine scroll at a lower joint; moveably attaching a liner to the housing at an upper joint, wherein the lower joint and the upper joint provide multiple axes of movement for the liner; maintaining the upper joint in a connected state by providing a first resilient force to the liner in a first direction from the swirler to the liner with a vibration damper/thermal and mechanical spring; providing a second resilient force to the liner in a second direction, orthogonal to the first direction, thereby minimizing movement of the liner in the second direction; inserting an igniter in a hole in the liner, the hole having a diameter larger than a diameter of the igniter; moveably sealing the igniter in the hole with a grommet; moveably contacting the turbine scroll with a first surface of a forging ring; attaching a second, opposite surface of the forging ring to the liner, wherein the first surface forms a substantially spherical point of contact between the liner and the turbine scroll and the second surface has a diameter smaller than a diameter of the second surface; forming a louver from a portion of the liner extending past a point of attachment of the second surface and the liner, the louver deflecting hot gases from the lower joint during operation of the turbine engine; providing fine holes in the forging ring; deflecting air from the upper joint with an upper joint louver; cooling the upper joint with sweep holes in the upper joint; and extending a carbon deflector into a combustion zone around the upper joint.

In a further aspect of the present invention, a method for making a multi-axial pivoting liner for a turbine engine comprises brazing or machining a swirler between a sleeve and an upper joint to form an inner race; forming a louver in the multi-axial pivoting liner; welding an upper outer joint to the louver to form a louver/liner assembly; inserting the inner race in the louver/liner assembly; and capturing the louver liner assembly by welding the retaining ring to the inner race.

In still a further aspect of the present invention, a gas turbine engine comprises the multi-axial pivoting liner made according to the method of the present invention.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

The present invention provides a method for making a multi-axial pivoting liner within the combustion system of a turbine engine. The pivoting liner allows the system to work with minimum thermal interference, especially during system operation at transient conditions, by allowing the liner to pivot and slide about its centerline and relative to the turbine scroll. The pivoting liner should also have the ability to control and minimize air leakage from part to part, for example, from the liner to the turbine scroll and from the swirler to the liner, during various operating conditions. Additionally, the liner should also provide for easy assembly with no steps in the combustion gas flow path. Finally, the liner should tolerate thermal and mechanical stresses and minimize wear.

Conventional combustor liners are often supported on one end or suspended by a few points. The conventional liner assembly and fabrication technique is adequate only for low cycle and low performance engines. Thermal and mechanical stresses on a conventional liner in a high performance engine may result in liner damage and/or air leakage. The thermal and mechanical stress on the liner must be minimized to meet a minimum fatigue requirement. In accommodating this cycle requirement, the liner of the present invention is designed to pivot to wherever the thermal displacements of the combustor housing and the scroll dictate.

Figure 1:
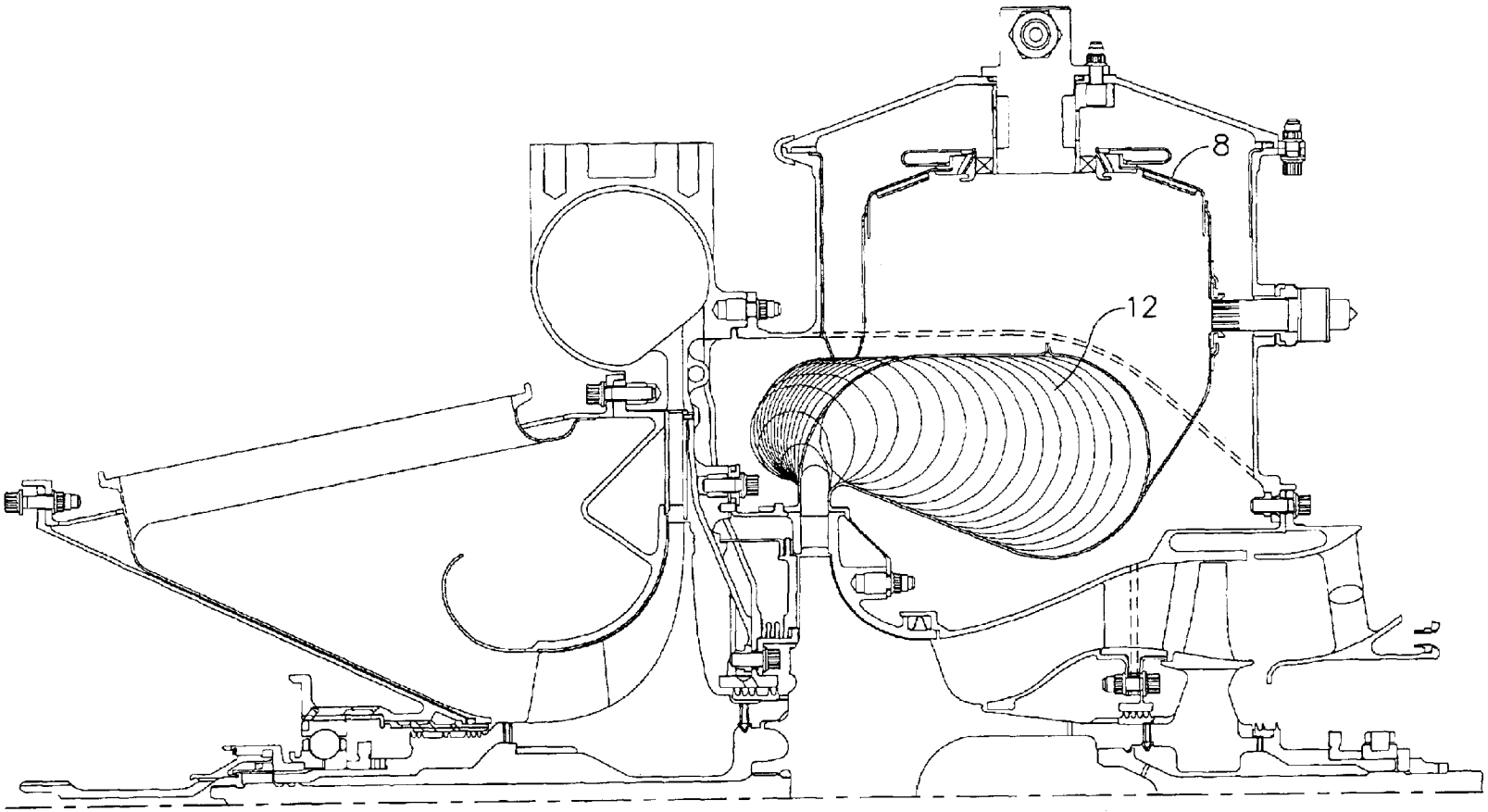
FIG. 1 is a partial cross-sectional view of a power section of a turbine engine having a pivoting liner prepared according to the method of the present invention.

Referring to FIG. 1, there is shown a partial cross-sectional view of a power section of a turbine engine having a pivoting liner assembly 8 according to the present invention. Pivoting liner assembly 8 may be attached to turbine scroll 12 which delivers the combustor output gases to drive a turbine.

Figure 2:
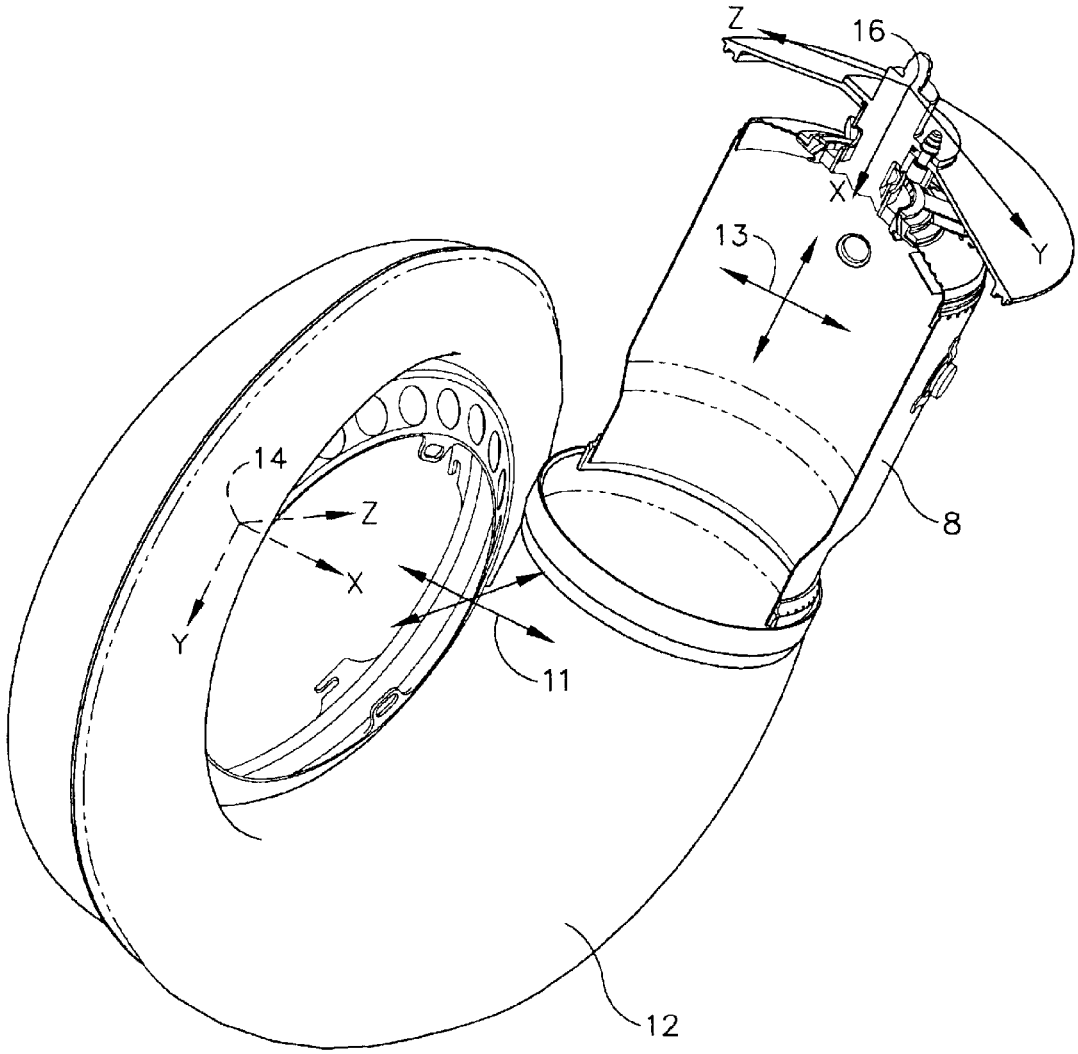
FIG. 2 is a partially cut-away perspective view showing the axes of thermal displacement of the pivoting liner prepared according to the method of the present invention and turbine scroll attached to this pivoting liner.

Referring now to FIG. 2, there is shown a partially cut-away perspective view showing the axes of thermal displacement of pivoting liner assembly 8 and turbine scroll 12. During a thermal cycle of the turbine engine, turbine scroll 12 may deflect as shown by scroll coordinates 14. At the same time, liner assembly 8 may deflect, as shown by liner coordinates 16. These two sources of thermal deflection vectors shown in 11 and 13, along two coordinate systems 14, 16, may create a high degree of mechanical stress on liner assembly 8 and turbine scroll 12 of the system. By providing pivoting liner assembly 8, thermal and mechanical stress on liner assembly 8 and turbine scroll 12 of the system are minimized, allowing the system to meet fatigue requirements.

Figure 3:
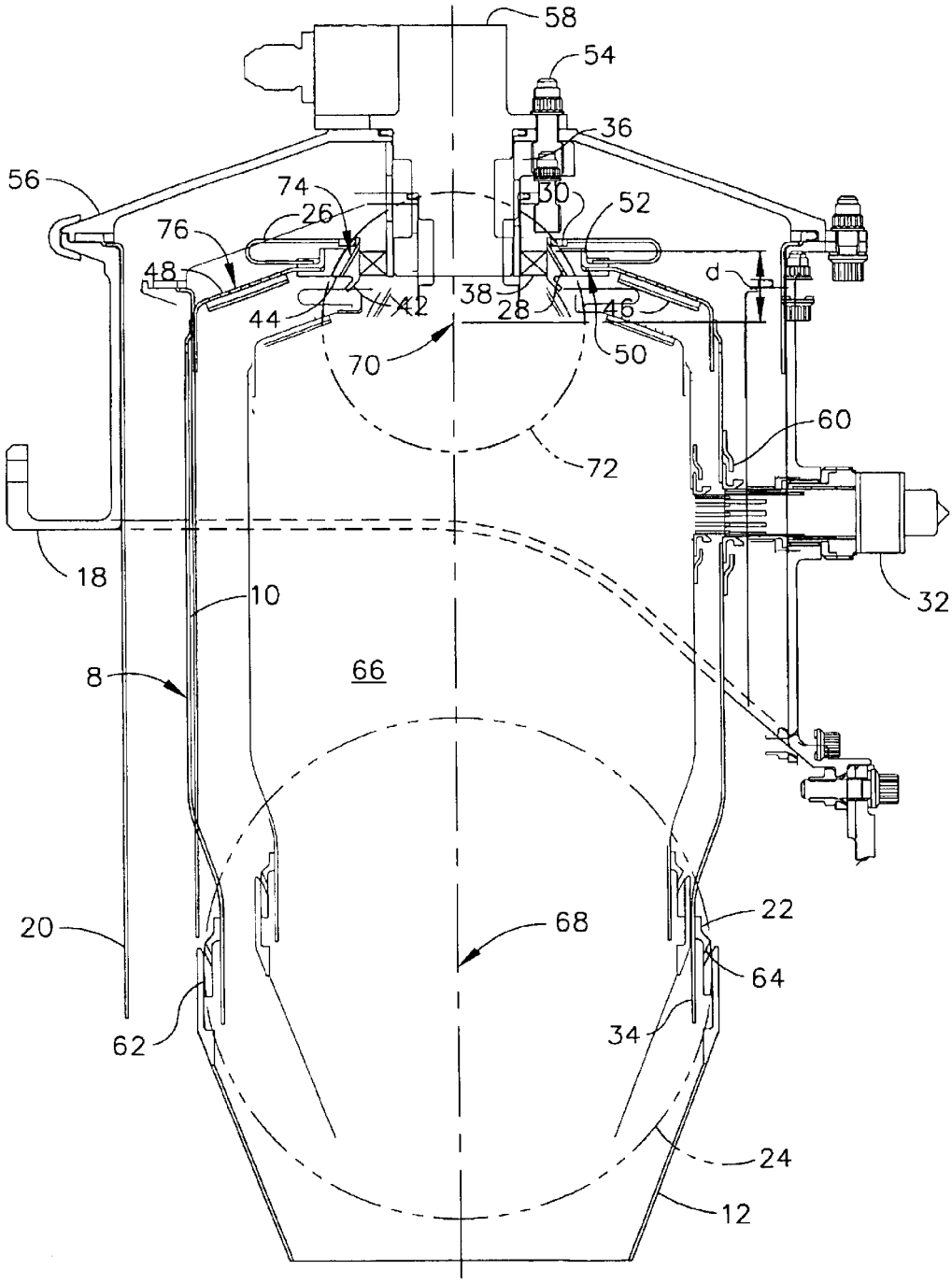
FIG. 3 is a schematic view of multi-axial pivoting liner prepared according to the method of the present invention.
Figure 4:
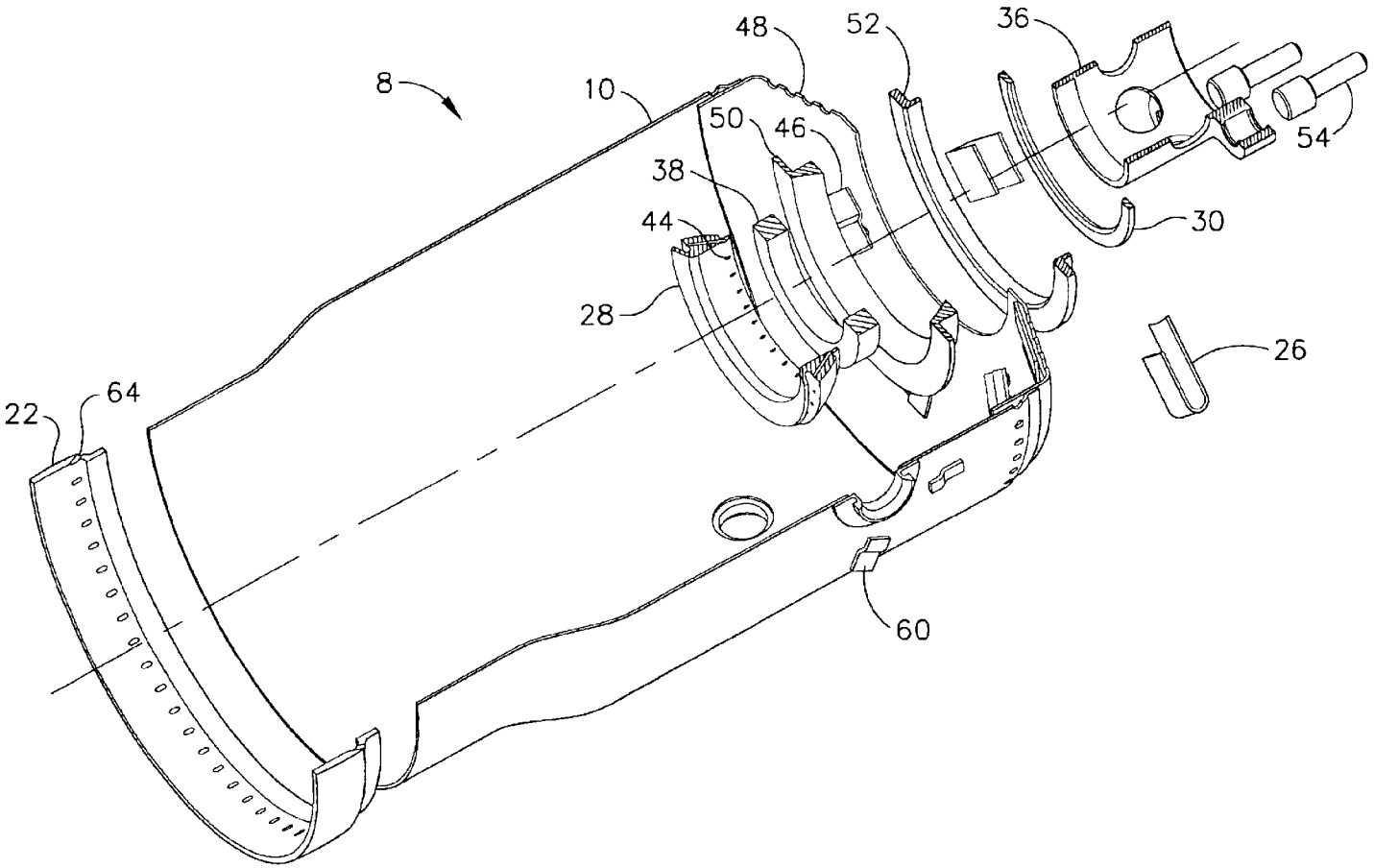
FIG. 4 is a cut-away perspective view showing the assembly of the multi-axial pivoting liner of FIG. 3.
Figure 5:
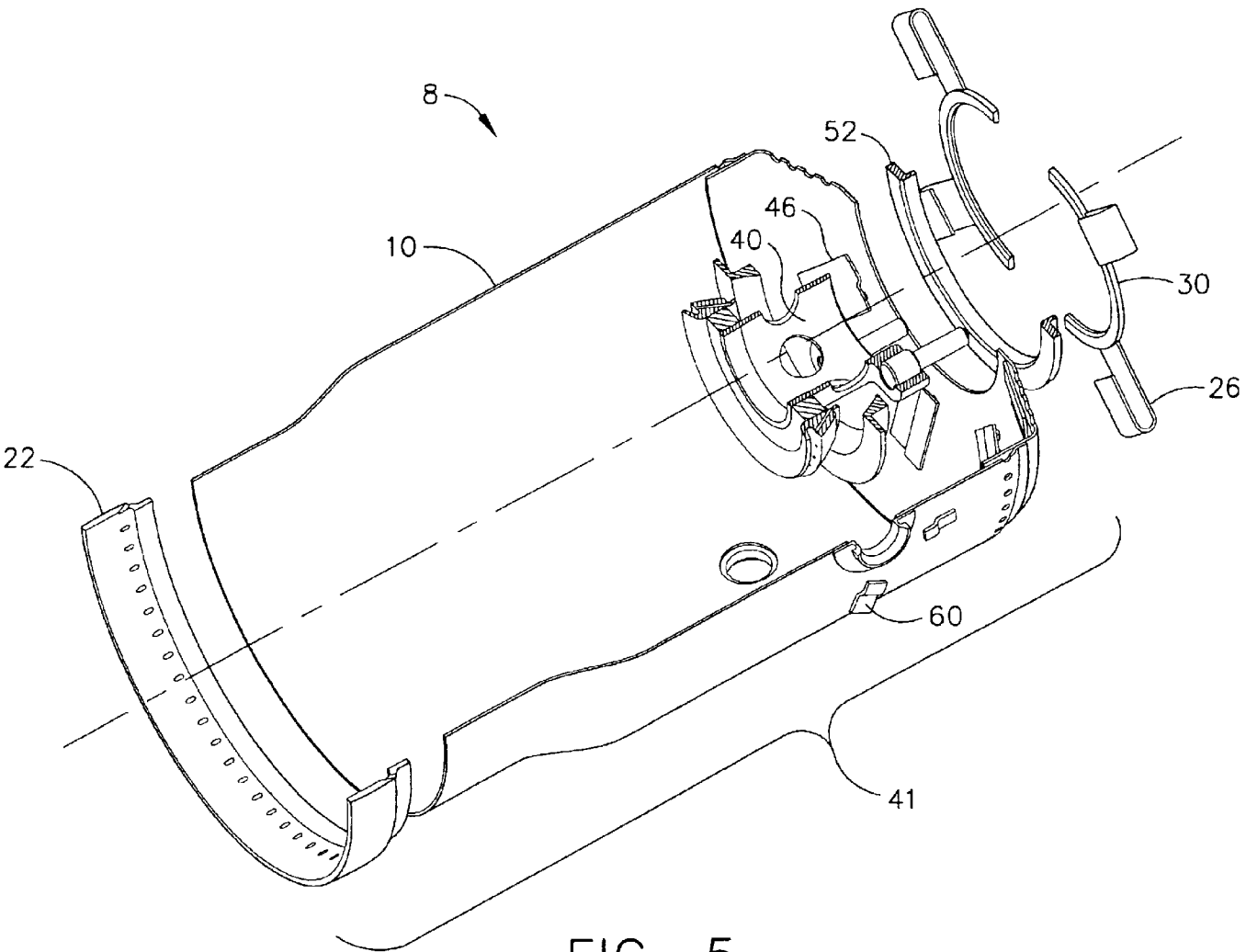
FIG. 5 is a cut-away perspective view showing the assembly of the multi-axial pivoting liner of FIG. 3 after some parts have been assembled.

Referring to FIGS. 3 through 5, there are shown partially cut-away schematic views of the assembly of the multi-axial pivoting liner. Liner assembly 8 partially encases a combustor zone 66 of the turbine engine. Liner assembly 8 may be designed to pivot within a combustor housing 18 and an air deflector 20. A lower joint 22 allows liner assembly 8 to contact turbine scroll 12 and revolve with a circular line contact 24 along the spherical surface of a forging ring 62. Lower joint 22 may be designed to have a constant spherical circumference that may pivot on its own center, thereby permitting angular and axial motions along the liner centerline 68, maintaining a constant gap between liner assembly 8 and turbine scroll 12, and permitting relative motion along all possible axes. A series of fine holes 64 help maintain uniform temperature between lower joint 22 and turbine scroll 12. The maintenance of a substantially uniform temperature at lower joint 22 assists in controlling leakage by reducing thermal variations at lower joint 22. A louver 34 may be used to deflect hot gases from lower joint 22, thereby further assisting in the maintenance of uniform temperature of lower joint 22. Louver 34 may also help to provide a cooling film next to the surface of turbine scroll 12 and therefore control leakage by maintaining a specific gap between itself and turbine scroll 12. Louver 34 may be formed integral with liner 10 or a forging ring 62. Liner 10 may have forging ring 62 brazed thereto, providing contact with turbine scroll 12. This double overlap feature provided by lower joint 22 and louver 34 helps prevents the conventionally known thermal distortion at the liner 10/turbine scroll 12 joint. This forms a complete outer liner subassembly 41.

A vibration damper/thermal and mechanical spring 26 may provide a pre-load on an upper joint 28 at all times. The design of vibration damper/thermal and mechanical spring 26 is such that the pre-load on upper joint 28 is in both a first direction along a centerline 68 of liner 10, and a second direction, orthogonal to the first direction. This pre-load is especially useful to maintain contact during shipment and flight maneuvers when there may be unusually high g-forces acting on the turbine engine. At the end of vibration damper/thermal and mechanical spring 26 there may be welded a machined segment 30 to act as a surge stopper by preventing damage to an igniter 32 due to shear force. Vibration damper/thermal and mechanical spring 26 may be capable of supporting all flight maneuvering g loads while maintaining upper joint 28 in a joined state.

Upper joint 28 may be formed by contacting two substantially spherical surfaces, upper inner surface 74 and upper outer surface 50, to minimize leakage, provide wear surface area, and allow angular pivoting motion while constraining motion along the liner axial axis. Dimension "d" is the distance from upper joint 28 to an offset center point 70 of a sphere projected diameter 72. Dimension "d" is optimized to form the appropriate contact angle between liner centerline 68 and the surface of upper joint 28 that formed upper inner surface 74 and upper outer surface 50. This optimization of dimension "d" helps prevent excessive friction force by maximizing the surface contact area.

Upper inner surface 74 may be brazed to or integrally formed with a bushing 36 and a swirler 38 to form an upper joint assembly 40. Upper inner surface 74 may also include a carbon deflector 42 to reduce or prevent carbon build up in the system. Sweep holes 44 may be provided to cool upper joint 28 and prevent carbon formation. A louver 46 and a series of louver holes 48 may be provided to deflect air and prevent carbon build up in a dome 76. Effusion cooling or an array of fine cooling holes may be provided as an alternative to prevent carbon formation as well. Upper-outer surface 50 sandwiches dome 76 within a retainer ring 52. Studs 54 may be used to hold the entire liner assembly 8 to combustor cap 56 together with an atomizer 58. Studs 54 may also maintain the position of liner assembly 8 during the replacement or inspection of atomizer 58. The resulting assembly allows liner assembly 8 to pivot at upper joint 28 and about point 70 while accommodating thermal relative growth between liner assembly 8, turbine scroll 12, combustor housing 18 and combustor cap 56.

Igniter 32 may use a grommet 60 in liner 10 to prevent igniter 32 from interfering with any movement of the system. This system helps relieve stress on igniter 32 during movement of either liner assembly 8 or turbine scroll 12.

Figure 6:
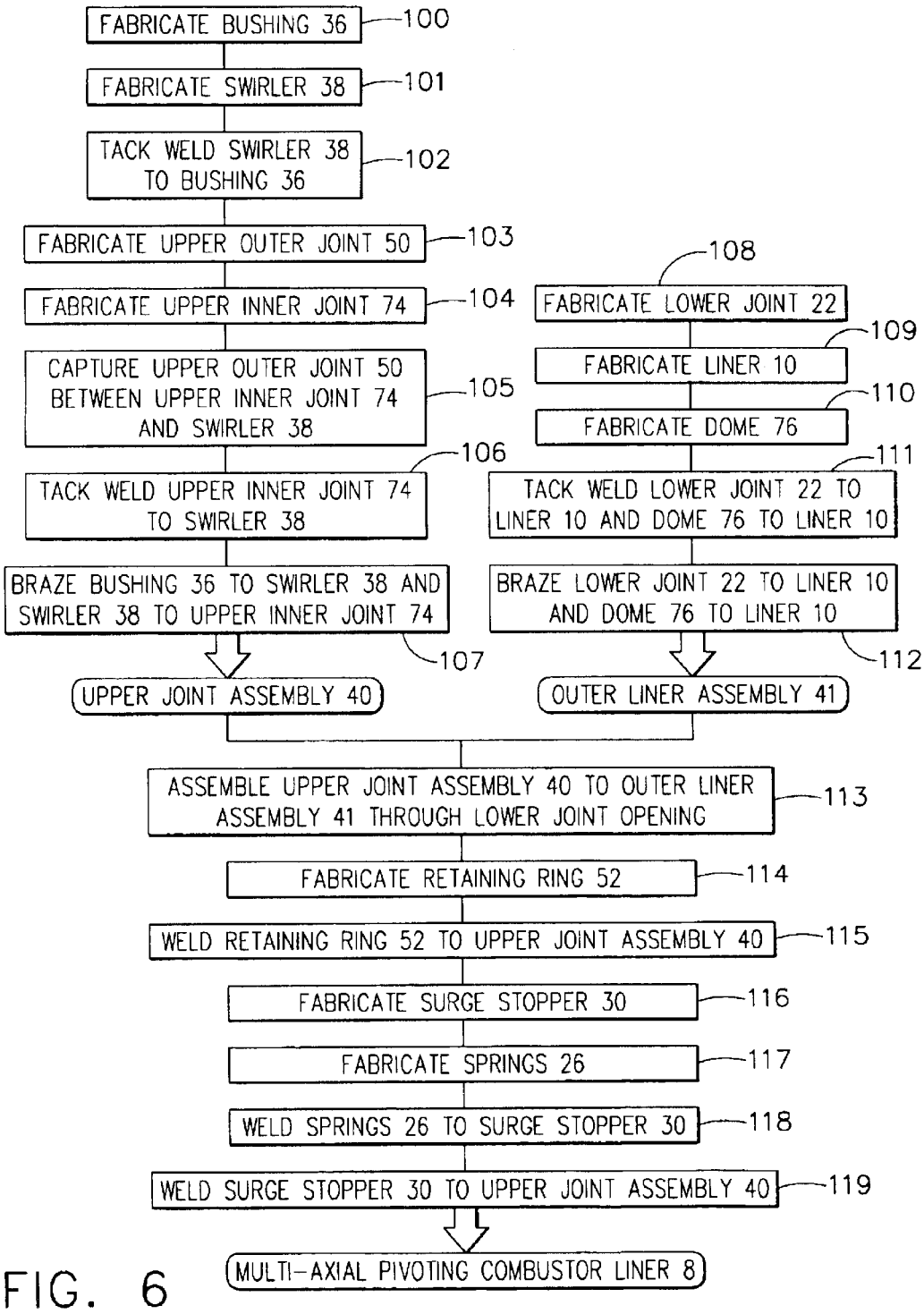
FIG. 6 is a schematic diagram showing the fabrication steps for making the multi-axial pivoting liner according to the present invention.

Referring now to FIGS. 4, 5 and 6, there is shown a schematic diagram of the assembly steps for the fabrication of the multi-axial pivoting liner according to the present invention. Bushing 36 and swirler 38 are fabricated and tack welded or machined together (steps 100, 101 and 102). Upper outer joint 50 and upper inner joint 74 are fabricated (steps 103 and 104). Fabricated upper outer joint 50 is then captured between fabricated upper inner joint 74 and swirler 38 (step 105). Upper inner joint 74 is then tack welded to swirler 38 (step 106). Finally, bushing 36 is brazed to swirler 38 and swirler 38 is brazed to upper inner joint 74 (step 107). This completes the fabrication of upper joint assembly 40.

Outer liner assembly 41 is formed separately from the above formed upper joint assembly 40. First, lower joint 22, liner 10 and dome 76 are fabricated (steps 108, 109 and 110). Lower joint 22 is then tack welded to liner 10 and dome 76 is tack welded to liner 10 (step 111). Finally, lower joint 22 is brazed to liner 10 and dome 76 is brazed to liner 10 (step 112). This completes the fabrication of outer liner assembly 41.

Upper joint assembly 40 is assembled with outer liner assembly 41 through lower joint opening (step 113). Retaining ring 52 is fabricated (step 114) and welded to upper joint assembly 40 (step 115). Surge stopper 30 (also known as machined segment 30) and springs 26 (also known as vibration damper/thermal and mechanical springs 26) are fabricated (steps 116 and 117). Springs 26 are then welded to surge stopper 30 (step 118). Finally, surge stopper 30 is welded to upper joint assembly 40 (step 119) to complete the fabrication of liner assembly 8.

It should be understood, of course, that the foregoing relates to preferred embodiments of the invention and that modifications may be made without departing from the spirit and scope of the invention as set forth in the following claims.

We claim:

1. A method for making a multi-axial pivoting liner assembly for a turbine engine comprising:

moveably connecting a liner with a combustion gas output receiving device at a lower joint; and moveably attaching said liner to a housing at an upper joint;

wherein said lower joint and said upper joint provide multiple axes of movement for said liner.

2. The method according to claim 1, wherein said combustion gas output receiving device is a turbine scroll.

3. The method according to claim 2, further comprising:

maintaining said upper joint in a connected state by providing a first resilient force to said liner in a first direction from said housing to said liner with a vibration damper/thermal and mechanical spring; and providing a second resilient force to said liner in a second direction, orthogonal to said first direction, thereby minimizing movement of said liner in said second direction.

4. The method according to claim 2, further comprising:

inserting an igniter in a hole in said liner, said hole having a diameter larger than a diameter of said igniter; and moveably sealing said igniter in said hole with a grommet.

5. The method according to claim 2, further comprising:

moveably contacting said turbine scroll with a first surface of a forging ring; and attaching a second, opposite surface of said forging ring to said liner;

wherein said first surface forms a substantially spherical point of contact between said liner and said turbine scroll and said second surface has a diameter smaller than a diameter of said second surface.

6. The method according to claim 5, further comprising forming a louver from a portion of said liner extending past a point of attachment of said second surface and said liner, said louver deflecting hot gases from said lower joint during operation of said turbine engine.

7. The method according to claim 6, further comprising providing fine holes in said forging ring.

8. The method according to claim 2, further comprising deflecting air from said upper joint with an upper joint louver.

9. The method according to claim 8, further comprising cooling said upper joint with sweep holes in said upper joint.

10. The method according to claim 2, further comprising extending a carbon deflector into a combustion zone around said upper joint.

11. A method for making a multi-axial pivoting liner assembly for a turbine engine comprising:

moveably connecting a liner with a turbine scroll at a lower joint;

moveably attaching said liner to a housing at an upper joint, wherein said lower joint and said upper joint provide multiple axes of movement for said liner;

maintaining said upper joint in a connected state by providing a first resilient force to said liner in a first direction from said housing to said liner with a vibration damper/thermal and mechanical spring;

providing a second resilient force to said liner in a second direction, orthogonal to said first direction, thereby minimizing movement of said liner in said second direction;

inserting an igniter in a hole in said liner, said hole having a diameter larger than a diameter of said igniter; and moveably sealing said igniter in said hole with a grommet.

12. The method according to claim 11, further comprising:

moveably contacting said turbine scroll with a first surface of a forging ring; and attaching a second, opposite surface of said forging ring to said liner;

wherein said first surface forms a substantially spherical point of contact between said liner and said turbine scroll and said second surface has a diameter smaller than a diameter of said second surface.

13. The method according to claim 12, further comprising:

forming a louver from a portion of said liner extending past a point of attachment of said second surface and said liner, said louver deflecting hot gases from said lower joint during operation of said turbine engine; and providing fine holes in said forging ring.

14. The method according to claim 13, further comprising:

deflecting air from said upper joint with an upper joint louver; and cooling said upper joint with dilution holes in said upper joint.

15. The method according to claim 11, further comprising extending a carbon deflector into a combustion zone around said upper joint.

16. A method for making a multi-axial pivoting liner assembly for a turbine engine of a high-performance aircraft comprising:

moveably connecting a liner with a turbine scroll at a lower joint;

moveably attaching a housing to said liner at an upper joint, wherein said lower joint and said upper joint provide multiple axes of movement for said liner;

maintaining said upper joint in a connected state by providing a first resilient force to said liner in a first direction from said housing to said liner with a vibration damper/thermal and mechanical spring;

providing a second resilient force to said liner in a second direction, orthogonal to said first direction, thereby minimizing movement of said liner in said second direction;

inserting an igniter in a hole in said liner, said hole having a diameter larger than a diameter of said igniter;

moveably sealing said igniter in said hole with a grommet;

moveably contacting said turbine scroll with a first surface of a forging ring;

attaching a second, opposite surface of said forging ring to said liner, wherein said first surface forms a substantially spherical point of contact between said liner and said turbine scroll and said second surface has a diameter smaller than a diameter of said second surface;

forming a louver from a portion of said liner extending past a point of attachment of said second surface and said liner, said louver deflecting hot gases from said lower joint during operation of said turbine engine;

providing fine holes in said forging ring;

deflecting air from said upper joint with an upper joint louver;

cooling said upper joint with dilution holes in said upper joint; and extending a carbon deflector into a combustion zone around said upper joint.

17. A method for making a multi-axial pivoting liner for a turbine engine comprising:

brazing or machining a swirler between a sleeve and an upper joint to form an inner race;

forming a louver in said multi-axial pivoting liner;

welding an upper outer joint to said louver to form a louver/liner assembly;

inserting said inner race in said louver/liner assembly; and capturing said louver/liner assembly by welding a retaining ring to said inner race.

18. The method according to claim 17, further comprising:

maintaining said upper joint in a connected state by providing a first resilient force to said multi-axial pivoting liner in a first direction from an atomizer to a turbine scroll with a vibration damper/thermal and mechanical spring; and providing a second resilient force to said multi-axial pivoting liner in a second direction, orthogonal to said first direction, thereby minimizing movement of said multi-axial pivoting liner in said second direction.

19. The method according to claim 18, further comprising:

inserting an igniter in a hole in said multi-axial pivoting liner, said hole having a diameter larger than a diameter of said igniter; and moveably sealing said igniter in said hole with a grommet.

20. The method according to claim 19, further comprising:

moveably contacting a turbine scroll with a first surface of a forging ring; and attaching a second, opposite surface of said forging ring to said multi-axial pivoting liner;

wherein said first surface forms a substantially spherical point of contact between said multi-axial pivoting liner and said turbine scroll and said second surface has a diameter smaller than a diameter of said second surface.

21. The method according to claim 20, further comprising:

forming a louver from a portion of said multi-axial pivoting liner extending past a point of attachment of said second surface and said multi-axial pivoting liner, said louver deflecting hot gases from said lower joint during operation of said turbine engine; and providing fine holes in said forging ring.

22. The method according to claim 21, further comprising extending a carbon deflector into a combustion zone around said upper joint.

23. A method for making a multi-axial pivoting liner assembly comprising:

forming an upper joint assembly by tack welding a swirler to a bushing; capturing an upper outer joint between an upper inner joint and said swirler; tack welding said upper inner joint to said swirler; brazing said bushing to said swirler; and brazing said swirler to said upper inner joint;

forming an outer liner assembly by tack welding a lower joint to a liner; tack welding a dome to said liner; brazing said lower joint to said liner; and brazing said dome to said liner;

assembling said upper joint assembly to said outer liner assembly through a lower joint opening;

welding a retaining ring to said upper joint assembly;

welding springs to a surge stopper; and welding said surge stopper to said upper joint assembly.

* * * * *